US008832881B2

(12) United States Patent
Polevoy et al.

(10) Patent No.: US 8,832,881 B2
(45) Date of Patent: Sep. 16, 2014

(54) BED FRAME HAVING PROTECTIVE PLASTIC CASING

(75) Inventors: Richard S. Polevoy, Teaneck, NJ (US); Paul Eric Carlson, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 439 days.

(21) Appl. No.: 12/932,669

(22) Filed: Mar. 2, 2011

(65) Prior Publication Data

US 2011/0219540 A1 Sep. 15, 2011

Related U.S. Application Data

(63) Continuation-in-part of application No. 12/660,694, filed on Mar. 2, 2010, now abandoned.

(60) Provisional application No. 61/165,493, filed on Mar. 31, 2009, provisional application No. 61/339,226, filed on Mar. 2, 2010.

(51) Int. Cl.
*A47C 19/02* (2006.01)

(52) U.S. Cl.
CPC ..... *A47C 19/021* (2013.01)
USPC ..... 5/663; 5/200.1; 5/201; 5/286; 362/130

(58) Field of Classification Search
USPC ..... 5/200.1, 201, 285, 286, 663, 424; 52/717.05; 248/345.1; 362/130
See application file for complete search history.

(56) References Cited

U.S. PATENT DOCUMENTS

| | | | | |
|---|---|---|---|---|
| 3,657,748 | A * | 4/1972 | Weinhart | 5/238 |
| 3,740,778 | A * | 6/1973 | Jordan et al. | 5/625 |
| 4,443,508 | A * | 4/1984 | Mehl | 428/122 |
| 6,076,212 | A * | 6/2000 | Feld | 5/663 |
| 6,826,790 | B1 * | 12/2004 | Polevoy et al. | 5/200.1 |
| 7,100,228 | B2 * | 9/2006 | Polevoy et al. | 5/663 |
| 7,363,664 | B2 * | 4/2008 | Polevoy et al. | 5/200.1 |
| 2005/0087663 | A1 * | 4/2005 | Schroeder | 248/345.1 |

* cited by examiner

*Primary Examiner* — Nicholas Polito
(74) *Attorney, Agent, or Firm* — Klauber & Jackson LLC

(57) ABSTRACT

A bed frame wherein the side rail and/or cross rails are fully encased in plastic shields. A plastic shield or shields cover the entire cross sectional area of the side and cross rails so that the side rail and cross rails are easy to handle and esthetically pleasing. The system avoids the need for a person to handle cold, sometimes dirty, steel and the cross and side rails may be T-shaped or L-shaped angle irons, or other configurations and covered with plastic shields. With the plastic shields, the steel members need not be finished since the outer appearance of the steel is encased by the plastic shields and not seen by persons.

20 Claims, 7 Drawing Sheets

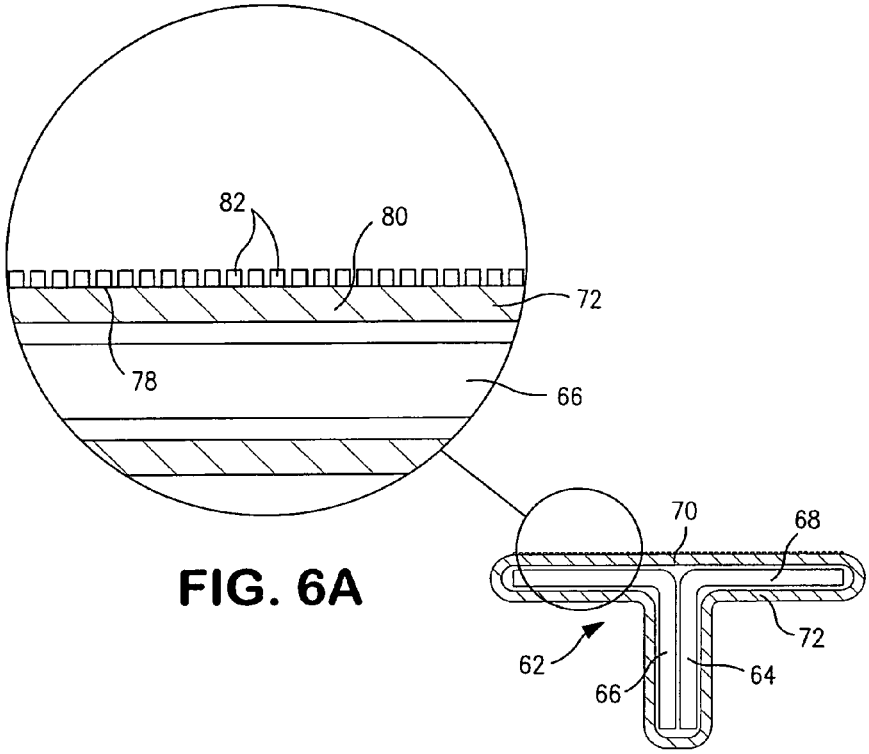
FIG. 6A
FIG. 6
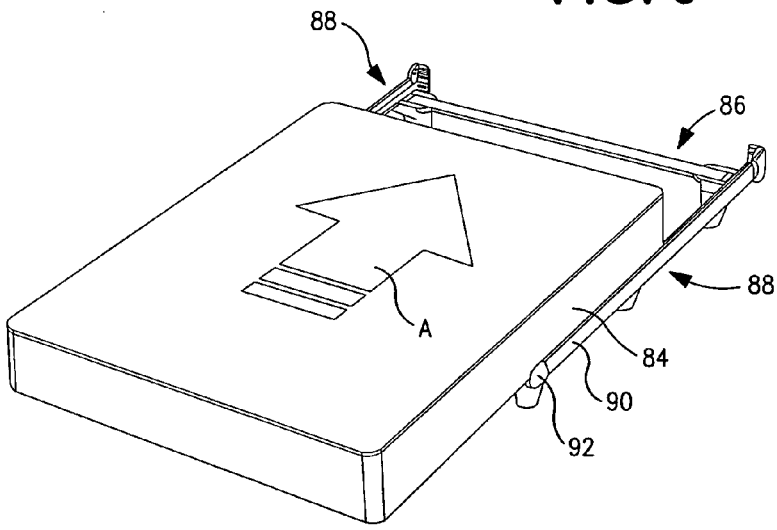
FIG. 7

BED FRAME HAVING PROTECTIVE PLASTIC CASING

REFERENCE TO RELATED APPLICATIONS

The present patent application is a continuation-in-part of, and hereby claims priority to, U.S. Non-Provisional application Ser. No. 12/660,694, filed Mar. 2, 2010 now abandoned entitled "Three Dimensional Connection System For Bed Frame", which in turn, claims priority from U.S. Provisional Application Ser. No. 61/165,493 filed Mar. 31, 2009. The present application also hereby claims priority to U.S. Provisional Application Ser. No. 61/339,226, filed Mar. 2, 2010 entitled "Bed Frame Having Protective Plastic Coating". Applicants claim the benefits of 35 U.S.C. §120 as to said Non-Provisional Application, and the benefits of 35 U.S.C. §119 as to said Provisional Applications, and the entire disclosures of all applications are incorporated herein by reference in their entireties.

FIELD OF THE INVENTION

The present invention relates to a bed frame for supporting a mattress or mattress set and, more particularly, to a bed frame that has a protective plastic casing that covers the structural components of the bed frame.

BACKGROUND OF THE INVENTION

There are currently in use conventional bed frame assemblies that are used for supporting a mattress or mattress set and such bed frame assemblies are normally made up of two side rails and at least one cross member. The bed frame supports the load of a mattress set by means of multiple support legs.

With many bed frames, the side rails and cross members are made of a metal, generally iron or steel, and the overall frame therefore has multiple sharp edges for the metal components. Further, the use of metal makes the bed frame a difficult platform on which the box spring and mattress are slid in assembling a bed. The metal material for bed frames is not particularly lubricious and therefore hampers the sliding of a box spring over the assembled frame and there is the possibility that one of the sharp edges of the bed frame will cause a tear in the box spring or mattress material.

Accordingly, it would be advantageous to provide a covering for a bed frame that is both protective of sharp edges as well as facilitate the sliding of a box spring over the bed frame in the assembly of a completed bed.

SUMMARY OF THE INVENTION

A feature of the present bed frame is that the metal frame is encased in plastic, thereby allowing the box spring and mattress to easily slide in place on top of the frame without contact with the metal, that is, along some portion or all of the length of a side rail or cross rail, the rail is totally surrounded by a plastic shield. The side rails and the cross rails are encased in a plastic shield and there are plastic injection molded end caps. With the present invention, therefore, the side and/or cross rail for a bed frame can be encased with plastic shields at the point of manufacture such that the rails are shipped with the plastic shields assembled thereto. As such, each step of the assembly of the bed frame using a plastic shielded component can have the advantage of the present invention since that assembly does not need to deal with hard steel components.

In an exemplary embodiment, the side rails are made from one or more rail steel angle iron pieces, however any structural metal beam can be used with the present invention including rolled tubing and folded strips. The plastic is a more lubricious surface than the steel and therefore the task is made simpler requiring less exertion and stress. Secondly, the plastic is not abrasive to the fabric of the bedding and so the material is protected from damage or wear. Thirdly, the plastic serves to make the frame quiet by inhibiting any metal on metal squeaking. The staples or tacks in the box spring can make sound on a metal bed frame. The plastic forms an entirely flat platform for supporting the bedding. In an exemplary embodiment, there may be grooves formed on the surface of the plastic that serve to further deaden any sounds and inhibit vibration.

In an exemplary embodiment, the bed frame has a double angle iron side rail encased in a plastic extrusion. This side rail is more rigid because it has a tall vertical proportion. The plastic serves to dress the frame and make it more like traditional finished furniture as well as to make the steel more comfortable and safer to handle because it is softer and has few edges.

The cross rails are preferred to also be made of two piece of angle iron covered by a plastic extrusion. This allows the cross rail to also present the appearance of a finished part. The ends of the cross rails are capped with an injection molded end caps. All metal rails, both assembled and unassembled, are encased by plastic. The plastic shield could be manufacture in many ways including injection molding, insert injection mold, and coating. A preferred method of manufacture is to extrude the shield. Ribs are utilized on the inside of the extrusion to support the shaping and hold the internal metal structure in place. These ribs can take a number of different configurations. The preferred rib configuration is to have two ribs hanging straight down from the curved surface to contact the metal structure. These would be positioned only about a 0.25 inch inboard of the outer edges of the metal. In this way, the ribs will not fall off the edge but are also as short as possible. This will help with the thickness and consistency during manufacture.

In a further embodiment, the side rail of the bed frame is constructed of a single L shaped angle iron completely encased in plastic. The vertical flange of the angle iron extends upwardly to form a ridge to retain the bedding from side to side movement. The plastic extends downward below the horizontal portion of the angle. In this way, the side rail has a larger visual impact on the appearance of the bedding. Also this serves the function of covering the cut end of the cross rails at the point they connect to the side rails.

In addition the plastic overhang allows for the addition of lighting where the wiring and the fixtures are shielded from view. This light serves as a safety feature but also makes the bed more visually exciting. The plastic shield could be manufactured in many ways including injection molding, insert injection mold, and coating. A preferred method of manufacture is to extrude the encasement. Ribs are required on the inside of the extrusion to support this shaping and hold the internal metal structure in place. These ribs can be provided in a number of different configurations.

In a further embodiment, the side rail of the bed frame is constructed of a single L shaped angle iron completely encased in plastic with the vertical flange of the angle iron extending downwardly such that the leg of the angle perpendicular to the floor is positioned below the bottom surface of the bedding. In this case, the plastic is extended above the vertical member of the angle iron to form a ridge that retains the bedding against side to side movement. In this way, the side rail has a larger visual impact on the appearance of the bedding.

Also the rail downward turned flange of the angle iron serves the function of covering the cut end of the cross rails at the point they connect to the side rails. In addition the plastic overhang allows for the addition of lighting where the wiring and the fixtures are shielded from view. As such, the geometry of the rail that allow for the rails rigidity is all below the bedding.

The upstanding rigid portion can be much abbreviated in height because it is only a retainer. This is critical when the box spring has pull out storage drawers that can be blocked by tall side rails. The plastic shield could be manufactured in many ways including injection molding, insert injection mold, and coating. A preferred method of manufacture is to extrude the encasement. The upstanding ridge of plastic could take many forms. The preferred embodiment would be a hollow loop within extending from the main body of the plastic shield. Within the upstanding loop there is a ribbed reinforcement to provide strength to the otherwise unsupported member.

As a still further exemplary embodiment, since the plastic shields are affixed to the bed frame component at the manufacturers location, the manufacturer can provide the bed shields in a variety of standard or custom colors so that the ultimate user may have a bed frame components that are of a particular color to match the room or to identify the component as applicable for a particular size or type of bed frame. Thus, the manufacturer can use a customer-selected color of plastic shield and that specific color bed frame components can be boxed up and shipped to the customer with the desired color.

These and other features and advantages of the present invention will become more readily apparent during the following detailed description taken in conjunction with the drawings herein.

BRIEF DESCRIPTION OF THE DRAWINGS

FIGS. 6 and 6A are a cross sectional view and an enlarged cross sectional view of a cross rail having a plastic shield with surface grooves;

FIG. 7 is a schematic view illustrating a mattress/foundation sliding on an entirely plastic encased bed frame;

DETAILED DESCRIPTION OF THE INVENTION

Figure 1:
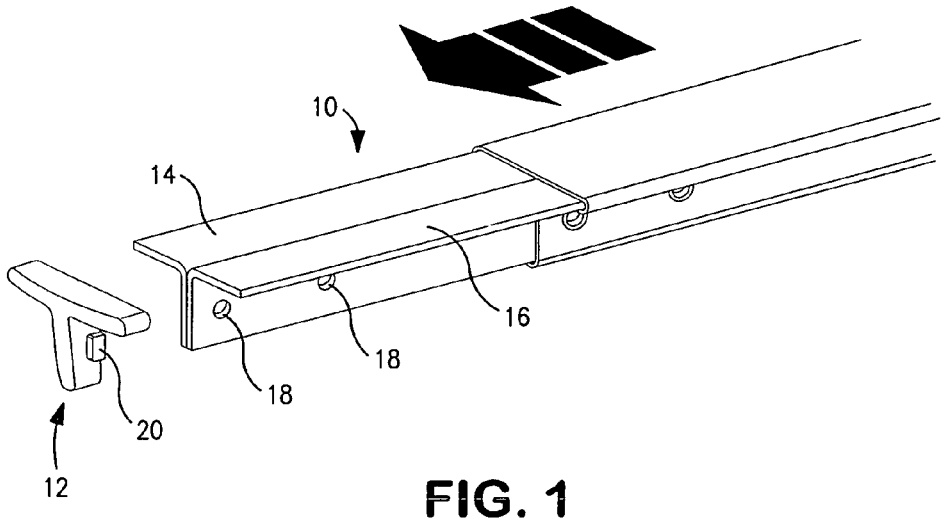
FIG. 1 is an exploded view illustrating a cross rail bed frame member having a protective plastic end cap.

Turning to FIG. 1, there is shown an exploded view illustrating a bed frame cross rail 10 having a protective plastic end cap 12 that fits over the end of the cross rail 10 to cover the sharp edges that are present at the ends of the cross rail 10. As can be seen, the cross rail 10 is comprised of two angle irons 14, 16 secured together by means such a rivets 18 to form a T-shape. As is well known, the ends of such cross rails result in sharp edges of the angle irons 14, 16 that can be hazardous to a person striking a sharp edge. The end cap 12 is also therefore a T-shape and fits over the ends of the cross rails 10 and may include an enlarged pocket 20 to enable the end cap 12 to slip over a rivet where necessary. Although only one end cap 12 is illustrated, both ends of the cross rails 10 may be protected by an end cap 12.

Figure 2:
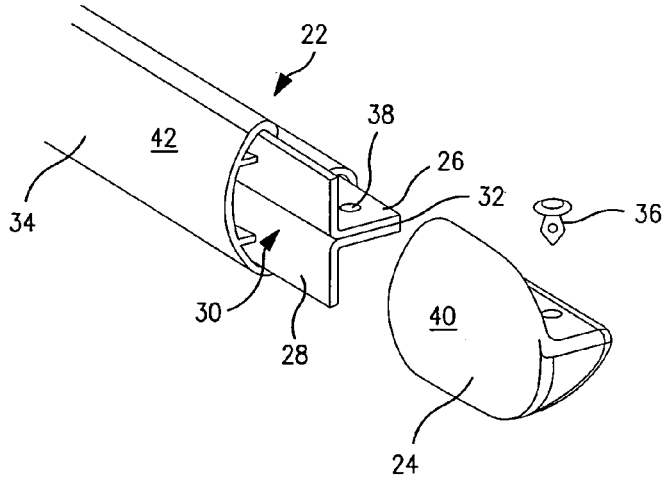
FIG. 2 is an exploded view illustrating a side rail bed frame member having a protective plastic end cap.

Next, in FIG. 2, there is an exploded view of a side rail 22 and a plastic end cap 24 that fits over the end of the side rail 22. In this embodiment, again, there are two angle irons 26, 28 that are secured together forming a combined vertical flange 30 and an overlapping inwardly directed horizontal flange 32. There is also a plastic shield 34 that covers the external surface of the vertical flange 30 and abuts against the end cap 24 when the end cap 24 is slid onto the end of the side rail 22, thereby fully covering the exterior surface of the vertical flange 30. A fastener 36 can be used to secure the end cap 24 to the side rail 22 by passing though the end cap 24 and a hole 38 in the side rail 22. The exterior surface 40 of the end cap 24 can be designed to be of the same curvature as the exterior surface 42 of the plastic shield 34 so that the two components meet in a smooth junction.

Figure 3:
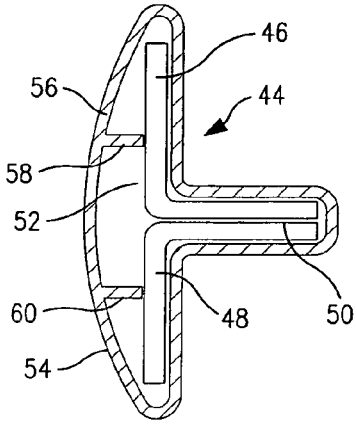
FIG. 3 is a cross sectional view of a side rail encased in plastic made with two angle irons.

Turning next to FIG. 3, there is shown a cross sectional view of a side rail 44 that, again, is constructed of two angle irons 46, 48 secured together. As can be seen, the combined angle irons 46, 48 forms an overlapping horizontal flange 50 and a combined adding vertical flange 52 that is twice the length of a vertical flange of the angle irons 46, 48. A plastic shield 54 fully surrounds the cross section of the side rail 44 such that the metal side rail 44 is completely covered and thus the cold steel or other metal is easier to handle and is more esthetically pleasing.

In the orientation of FIG. 3, the plastic shield 54 has an exterior portion 56 that is held away or displaced from the vertical flange 52 by means of ribs 58, 60 and which can be molded into the plastic shield 54. Since the plastic shield 54 is, in the embodiment of FIG. 3, unbroken, it can be slid along the longitudinal length of the side rail 44 in order to install the plastic shield 54 to the side rail 44.

Figure 4:
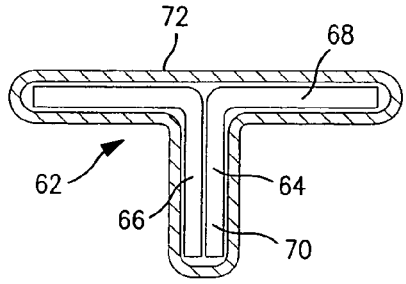
FIG. 4 is a cross sectional view of a cross rail encased in plastic made with two angle irons.

Turning next to FIG. 4, there is a cross sectional view of a cross rail 62 that is, again, made up of two angle irons 64, 66 that are secured together. In this embodiment, since the bed frame component is a cross rail, the cross rail 62 is oriented such that the upper, horizontal flange 68 is twice the length of a single flange of either of the angle irons 64, 66 and the vertical flange 70 overlaps the flanges of the angle irons 64, 66. Again, however, there is a plastic shield 72 that surrounds the entire cross section of the cross rail 62 so as to fully cover the metal angle irons 64, 66.

It should be noted, that while the description of a cross rail or side rail component making up a bed frame may be described as being comprised of two angle irons secured together, the present invention is equally applicable to a side rail or cross rail being provided as a single, unitary construction.

Figure 5A:
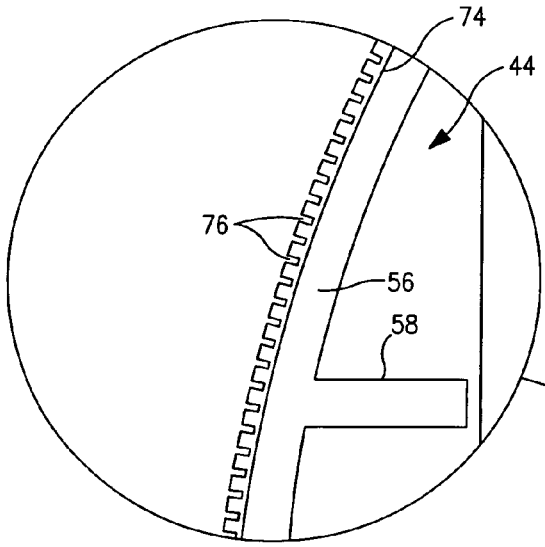
FIGS. 5 and 5A are a cross sectional view and an enlarged cross sectional view of a side rail having a plastic shield with surface grooves.
Figure 5:
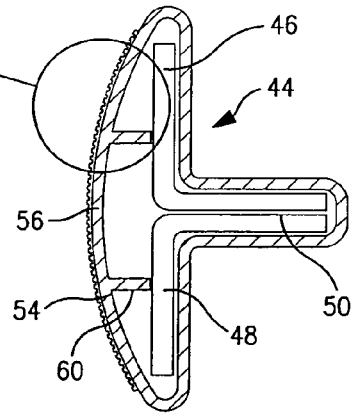

In FIGS. 5 and 5A, there is cross sectional view of a side rail and an enlarged cross section of a side rail 44 with the plastic shield 54 as shown in the embodiment of FIG. 3, however, the external surface 74 of the exterior portion 56 is curved outwardly and has surface grooves 76 formed thereon. The surface grooves 76 serve to further deaden any sounds and inhibit vibration. In addition, since the plastic shields may be extruded and have a shiny exterior finish, the use of the surface grooves 76 creates a finish that is less susceptible to marring or surface damage.

In FIGS. 6 and 6A, there is cross sectional view of the cross rail 62 and an enlarged cross section of the cross rail 62 with the plastic shield 72 as shown in the embodiment of FIG. 4, however, the external surface 78 of the upper portion 80 of the plastic shield has surface grooves 82 formed thereon.

Next in FIG. 7, there is a schematic view of a box spring 84 being slid onto a bed frame 86. As can be seen, the box spring 84 slides in the direction of the arrow A along the side rails 88. In accordance with the present invention, the side rails 88 are fully covered by a plastic shield 90, including end caps 92 such that the box spring 84 can slide easily and in a more lubricious manner than if the box spring 84 were sliding along raw steel side rails. The protective plastic end caps 92 prevent the otherwise sharp edges of the side rails 88 from cutting into the box spring and the smooth sliding action along the plastic shields 90 of the side rails 88 also minimizes damage to the box spring.

Figure 8:
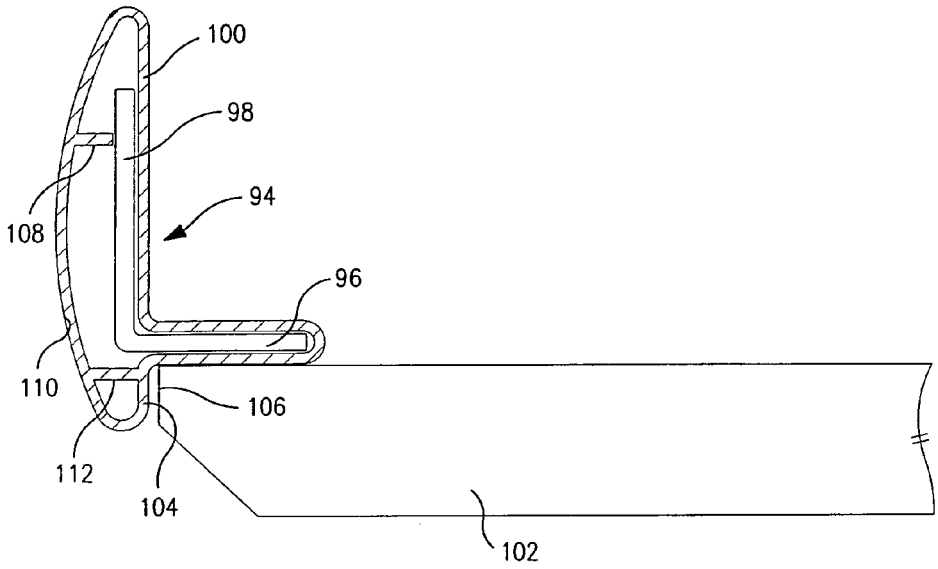
FIG. 8 is a cross sectional view of a side rail made with an angle iron encased in plastic having one upturned flange with a plastic shield blocking the end of a cross rail.

Turning to FIG. 8, there is shown a cross sectional view of a side rail 94 that is an L-shaped configuration, such as an angle iron, with a horizontal flange 96 positioned to underlie a box spring (not shown) and a vertical flange 98 extending upwardly from the horizontal flange 96 and adapted to be positioned proximate to, and run along, the outside edge of a box spring. Again, there is a plastic shield 100 that fully encases the side rail 94 so as to enclose the side rail 94 entirely. FIG. 8 also shows a cross rail 102 of a bed frame and, as can be seen, there is a downwardly directed portion 104 of the plastic shield 100 that extends below the horizontal flange 96 and which covers the outer end 106 of the cross rail 102 to provide protection again a person inadvertently encountering that outer end 106 and being injured.

As such, the plastic shield 100 not only encases the side rail 94 for protection to make the side rail 94 easier to handle and maneuver, but when the side rail 94 is assembled in constructing a bed frame, the same plastic shield 100 affords protection for persons by covering the outer end 106 of a cross rail 102.

In the embodiment of FIG. 8, there can also be seen a rib 108 that contacts the vertical flange 98 to position the exterior portion 110 of the plastic shield 100 outwardly from the vertical flange 98 and also a reinforcing rib 112 that adds strength and rigidity to the downwardly directed portion 104.

Figure 9:
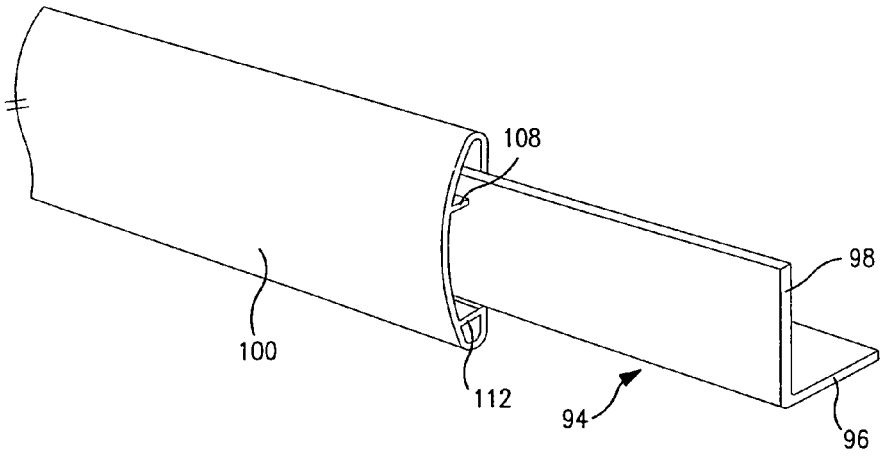
FIG. 9 is a perspective view illustrating the visual difference between a raw angle iron and the plastic encasement covering the angle iron.

Turning then to FIG. 9, then is shown a perspective view of the side rail 94 of FIG. 8 with a portion of the plastic shield 100 removed so that a distinction can be seen between the easily handled and protected portion of the side rail 94 protected by the plastic shield 100 and the bare portion of the side rail 94 where there is no such protection.

Figure 10:
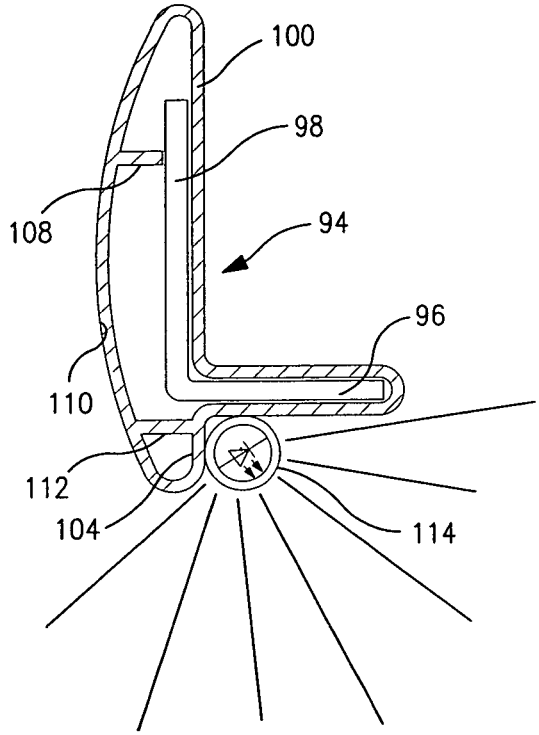
FIG. 10 is a cross sectional view of a side rail of FIG. 8 with a lighting strip concealed behind the plastic shield.

Turning to FIG. 10, there is a cross sectional view of a further exemplary embodiment of the side rail 94 of FIG. 8. In FIG. 10, a light 114, such as a fluorescent light, is located underneath the horizontal flange 96 and thus is underneath the box spring and mattress and is located interior of the downwardly directed portion 104 and is therefore in a protective location where the light 114 cannot be easily kicked or otherwise struck by a person or objects nearing the bed frame.

Figure 11:
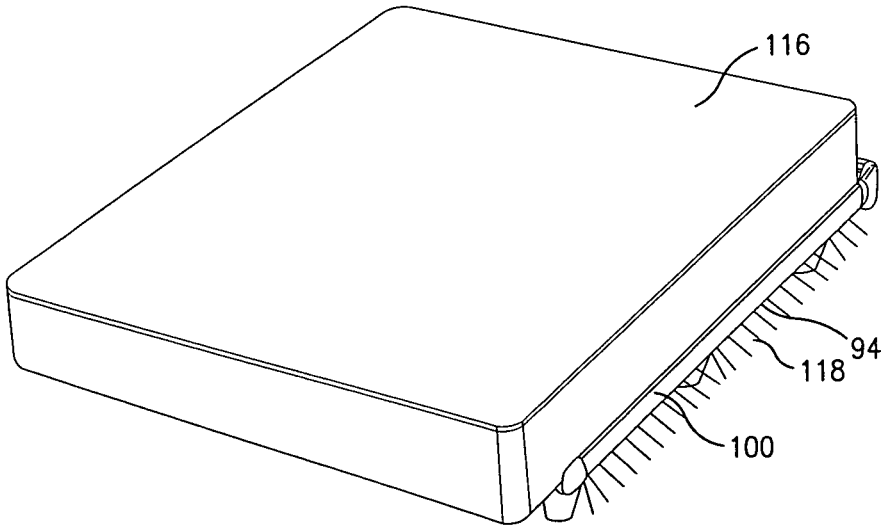
FIG. 11 is a perspective view illustrating bed frame and mattress with the concealed light of FIG. 10.

In FIG. 11, taken along with FIG. 10, there is a perspective view of a box spring 116 and showing the side rail 94 having a plastic shield 100 and illustrating the effect of the indirect lighting where the light rays 118 are directed downwardly and inwardly by the downwardly directed portion 104 of the plastic shield 100 thereby creating a desirable lighting effect.

Figure 12:
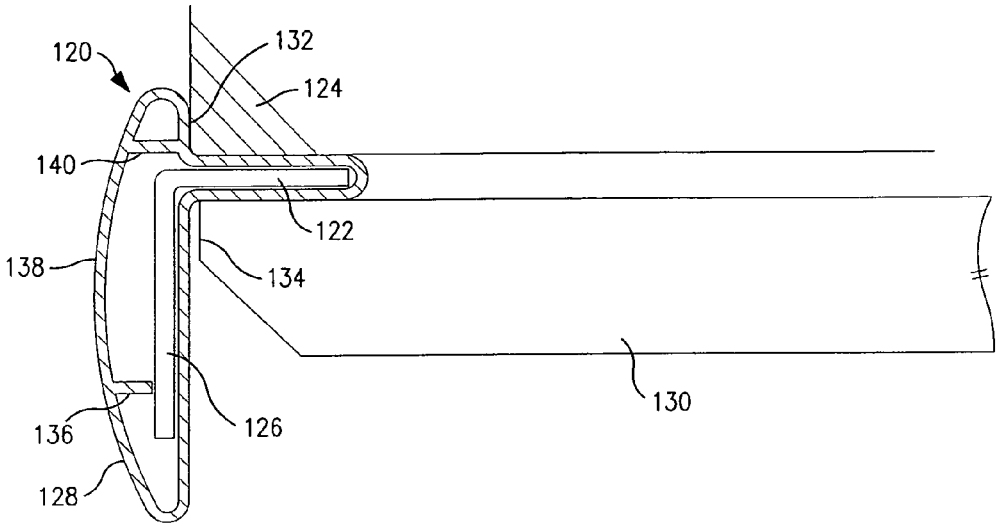
FIG. 12 is a cross sectional view of a side rail made with an angle iron encased in plastic having one downturned flange with a plastic shield blocking the end of a cross rail with a plastic lip for retaining the bedding.

Turning next to FIG. 12, there is shown a cross sectional view of an alternative embodiment of a side rail 120 that is an L-shaped configuration, such as an angle iron, with a horizontal flange 122 positioned to underlie a box spring 124 and a vertical flange 126 extending downwardly from the horizontal flange 122, that is, the vertical flange 126 extends beneath the box spring 124 and is adapted to be positioned proximate to, and run along, the outside edge of the box spring 124.

Again, there is a plastic shield 128 that fully encases the side rail 120 so as to enclose the side rail 120 entirely. FIG. 12 also shows a cross rail 130 of a bed frame and, as can be seen, there is a upwardly directed portion 132 of the plastic shield 128 that extends above the horizontal flange 122 and which is located proximate to the box spring 124 and prevents the box spring 124 from movement in a lateral direction.

As such, the plastic shield 128 not only encases the side rail 120 for protection to make the side rail 120 easier to handle and maneuver, but when the side rail 120 is assembled in constructing a bed frame, the same plastic shield 128 affords stability against lateral movement of the box spring 124 as well as protection against persons contacting the sharp outer end 134 of the cross rail 130.

In the embodiment of FIG. 12, there can also be seen a rib 136 that contacts the vertical flange 126 to position the exterior portion 138 of the plastic shield 128 outwardly of the vertical flange 126 and also a reinforcing rib 140 that adds strength and rigidity to the upwardly directed portion 132.

Figure 13:
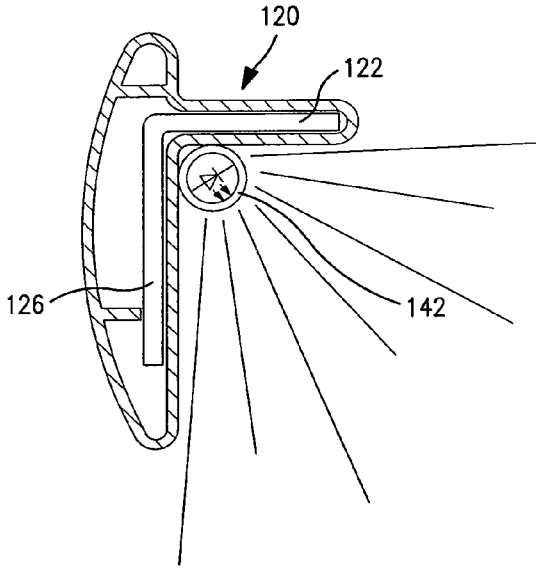
FIG. 13 is a cross sectional view of a side rail of FIG. 12 with a lighting strip concealed behind the downturned flange of the angle iron.

Turning then to FIG. 13, there is shown a cross sectional view of the side rail 120 of FIG. 12 further including a light 142 that can be positioned beneath the horizontal flange 122 and behind the vertical flange 126 so as to protect the light 142 from damage by persons or objects striking the light 142.

Figure 14:
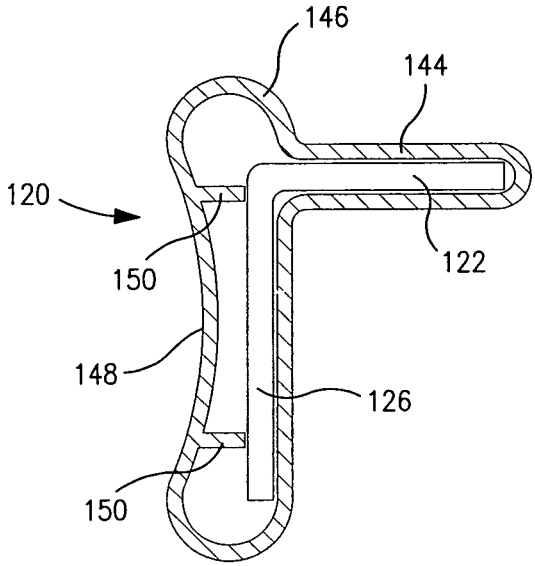
FIG. 14 is a cross sectional view of a side rail of FIG. 12 having standing ribs to support the outer portion of the plastic shield.

In FIG. 14, there is a side rail 120 that is constructed the same as in the FIG. 12 embodiment, that is, the side rail 120 is an L-shaped configuration, such as an angle iron, with the horizontal flange 122 positioned to underlie a box spring and the vertical flange 126 extending downwardly from the horizontal flange 122.

With the FIG. 14 embodiment, however the plastic shield 144 is of a slightly different configuration, that is, the upwardly directed portion 146 is more circular in appearance and the exterior portion 148 of the plastic shield 144 is concave inwardly in design and there are two ribs 148 that extend inwardly from the exterior portion 148 and contact the vertical flange 126 to add strength and rigidity to the plastic shield 144.

Figure 15:
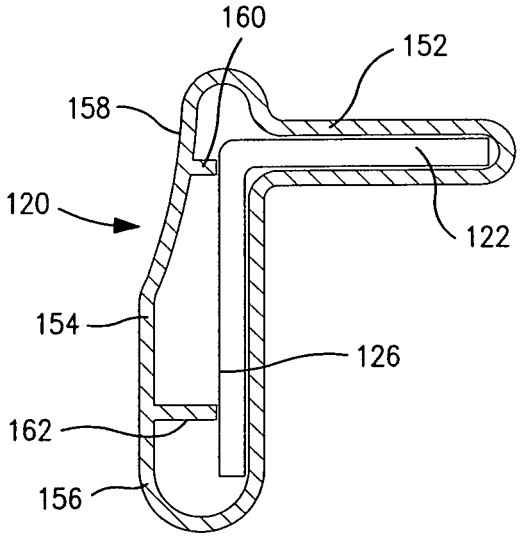
FIG. 15 is a cross sectional view of a side rail of FIG. 12 having a different configuration of outer portion of the plastic shield than the embodiment of FIG. 14.

Finally, in FIG. 15, there is a further embodiment wherein the plastic shield 152 has an outer portion 154 with a lower section 156 that is generally parallel to the vertical flange 126 with an upper section 158 that curves inwardly toward the vertical flange 126, such that an upper rib 160 is shorter that a lower rib 162.

While the present invention has been set forth in terms of a specific embodiment of embodiments, it will be understood that the present plastic shielding system for a bed frame herein disclosed may be modified or altered by those skilled in the art to other configurations. Accordingly, the invention is to be broadly construed and limited only by the scope and spirit of the claims appended hereto.

What is claimed is:

1. A bed frame assembly comprised of structural members including a pair of side rails and at least one cross rail connected between the pair of side rails, the pair of side rails and the at least one cross rail combining to provide a surface for supporting a mattress set, wherein at least one of the structural members comprises an elongated metal member having the entire length thereof totally surrounded and covered by an extruded, unbroken plastic shield that fully surrounds the entire surface of the metal member.

2. The bed frame assembly as defined in claim 1 wherein both of the side rails and all cross rails are fully surrounded by the unbroken plastic shield.

3. The bed frame assembly as defined in claim 1 wherein the pair of side rails both comprise metal members having a vertical flange and a horizontal flange for supporting a mattress set.

4. The bed frame assembly as defined in claim 3 wherein the plastic shield has an exterior portion and includes at least one rib that extends toward and contacts an outer surface of the vertical flange to allow the exterior portion of the plastic shield to have a different shape from the metal member.

5. The bed frame assembly as defined in claim 3 wherein the vertical flange extends downwardly from the horizontal flange.

6. The bed frame assembly as defined in claim 5 wherein the side rail is connected to a cross rail to construct a bed frame and wherein the vertical flange encased by the plastic shield extends downwardly below the vertical flange to cover sharp ends of the cross rail connected to intersecting with the pair of side rails rail.

7. The bed frame assembly as defined in claim 5 wherein a light is mounted in a location underneath the horizontal flange and inwardly of the downwardly extending vertical flange encase by the plastic shield.

8. The bed frame assembly as defined in claim 3 wherein a portion of the plastic shield extends upwardly above the horizontal flange to prevent the mattress set from moving laterally.

9. The bed frame assembly as defined in claim 3 wherein the vertical flange extends upwardly from the horizontal flange.

10. The bed frame assembly as defined in claim 9 wherein the side rail is connected to a cross rail to construct a bed frame and wherein the plastic shield has a downwardly extending portion that extends below the vertical flange to cover sharp ends of the cross rail intersecting with the side rail.

11. The bed frame assembly as defined in claim 10 wherein the downwardly extending portion has a reinforcing rib to strengthen the downward extending portion.

12. The bed frame assembly as defined in claim 10 wherein a light is mounted in a location underneath the horizontal flange and inwardly of the downwardly extending portion of the plastic shield.

13. A bed frame member comprised of a metal member having a first flange and a second flange extending outwardly from the first flange wherein the entire length of the metal member is covered by an unbroken, extruded-plastic shield that fully surrounds the entire surface of the metal member.

14. The bed frame member of claim 13 wherein the metal member is T-shaped comprised of two angle irons having flanges meeting at a right angle affixed together to form a first flange having the combined lengths of two flanges of each angle iron and a second flange that overlaps the flanges of the two angle irons, and wherein the first flange is vertically oriented.

15. The bed frame member as defined in claim 14 wherein the plastic shield has a curved portion proximate to the first flange and has at least one rib extending inwardly from the curved portion to contact the first flange of the metal member.

16. The bed frame member as defined in claim 15 wherein the curved portion of the plastic shield has an outer surface that has surface grooves formed thereon.

17. The bed frame member as defined in claim 13 having opposed ends and further including a plastic end cap fastened to at least one end of the metal member.

18. The bed frame member as defined in claim 13 wherein the metal member is comprised of two L-shaped angle irons having flanges meeting at a right angle affixed together to form a first flange having the combined lengths of the two flanges of each angle iron and a second flange that overlaps the flanges of the two angle irons, and wherein the first flange is horizontally oriented.

19. The bed frame member as defined in claim 18 wherein the plastic shield forms an upper surface having surface grooves formed thereon.

20. The bed frame member as defined in claim 13 having opposed ends and further including a plastic end cap fastened to at least one end of the metal member.

* * * * *